US006285846B1

(12) United States Patent
Suzuki et al.

(10) Patent No.: US 6,285,846 B1
(45) Date of Patent: Sep. 4, 2001

(54) FIXING DEVICE

(75) Inventors: Takashi Suzuki; Yoshitaka Fujinuma; Masayuki Ainoya, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/514,324

(22) Filed: Feb. 28, 2000

(30) Foreign Application Priority Data

Feb. 26, 1999 (JP) ..... 11-050081

(51) Int. Cl.[7] ..... G03G 15/16
(52) U.S. Cl. ..... 399/122; 399/327
(58) Field of Search ..... 399/122, 320, 399/325, 326, 327; 15/256.5, 256.51

(56) References Cited

U.S. PATENT DOCUMENTS 5,978,640 * 11/1999 Segawa ..... 399/327
5,999,786 * 12/1999 Saito ..... 399/327

* cited by examiner

*Primary Examiner*—Sophia S. Chen
*Assistant Examiner*—Hoan Tran
(74) *Attorney, Agent, or Firm*—Sughrue, Mion, Zinn, Macpeak & Seas, PLLC

(57) ABSTRACT

A fixing device has a web unit with a housing having two shaft members in parallel with each other, the housing defining a through hole on each of two lateral sides of the housing. The web unit also has a web member windably supported by the two shaft members, and a handle having two protrusion protruded from a lateral surface of the housing to outside of the housing. Each of the two protrusions defines a first width and a second width larger than the first width. The fixing device also has a fixing device frame to be detachably disposed to the web unit. The fixing device frame has a guiding groove with a groove through which the two protrusions are guided on the basis of the first width, and a guiding portion at an end of the groove to allow the two protrusions to be changed from the first width to the second width. The attachment or detachment of the web unit to or from the fixing device frame is regulated corresponding to a position of the handle with respect to the housing.

4 Claims, 6 Drawing Sheets

FIXING DEVICE

BACKGROUND OF THE INVENTION

1. Field of the Invention

The present invention relates to a fixing device, in which a web unit having a windable web member is detachably provided to a fixing device frame.

2. Description of the Related Art

An fixing device is the well-known device in which a web unit having a windable web member is detachably provided to a fixing device frame, for example, in Japanese unexamined patent publication No. 3-267984.

In the above-described conventional technology, such a care is taken that a housing of the web unit is made of heat resistive resin or a heat resistive sheet is adhered onto a grip area at the web unit replacement. However, because the web unit is located right above a fixing heat roller which is heated to about 200° C., it is not necessarily a safe structure to be handled with empty-hands by the operator.

Further, because there is no structure to directly fix the web unit to the fixing device frame, the print can be conducted even when the mounting of the web unit is imperfect. Therefore, there is a disadvantage that mid-insertion of the web unit can not be prevented.

SUMMARY OF THE INVENTION

An object of the present invention is to solve the above problems of the conventional technology, and to provide a highly reliable fixing device in which the replacement of the web unit can be easily and correctly conducted, and a printing failure is not generated due to imperfect attachment of the web unit to the fixing device frame. Further, another object of the present invention is to provide a fixing device in which the safety during the web unit replacement is improved.

The above object can be attained by the following structure. A fixing device (7) which has a web unit (73) provided with a housing (731) which holds two shaft members (732, 732) in parallel with each other, and a web member (733) supported so that it can be wound around the shaft members, and in which the web unit is detachably provided with the fixing device frame (700), wherein the web unit (73) has through holes **(731*a*, 731*b*) provided on the housing side surfaces, and a handle (734) having protrusions (734*a*, 734*b*) formed into a sectional form having the first width (W1) and the second width (W2) larger than the first width, in which the protrusions can engage with the through holes, and protrude from the hosing side surfaces toward the outside in the condition being engaged with the through holes, and the fixing device frame has a guide groove (701) provided with a groove portion (701*a*) to guide the protrusions based on the first width, and a guide portion (701*b*) to allow the switching of the protrusions from the first width to the second width at the last stop of the groove portion, and the attachment and detachment of the web unit (73) to and from the fixing device frame (700) are regulated according to the position of the handle (734) to the housing (731)**.

DETAILED DESCRIPTION OF THE PRESENT INVENTION

Figure 1:
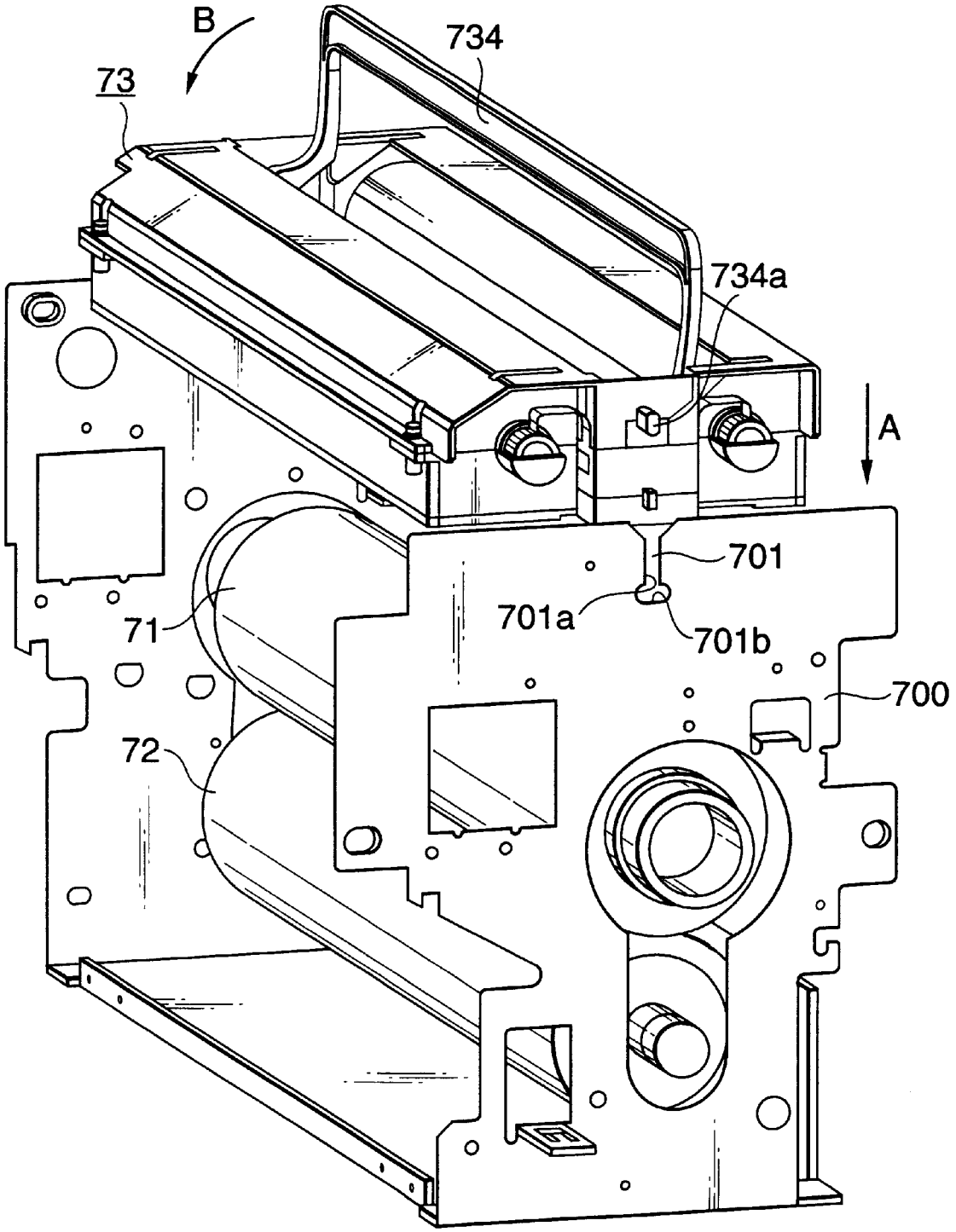
FIG. 1 is a perspective view showing a condition that a web unit is attached to a fixing device frame in a fixing device of the present invention.

The present invention will be described below referring to the drawings.

Initially, referring to FIG. 6, the overall structure of a laser printer will be described in which the fixing device of the present invention is mounted.

Figure 6:
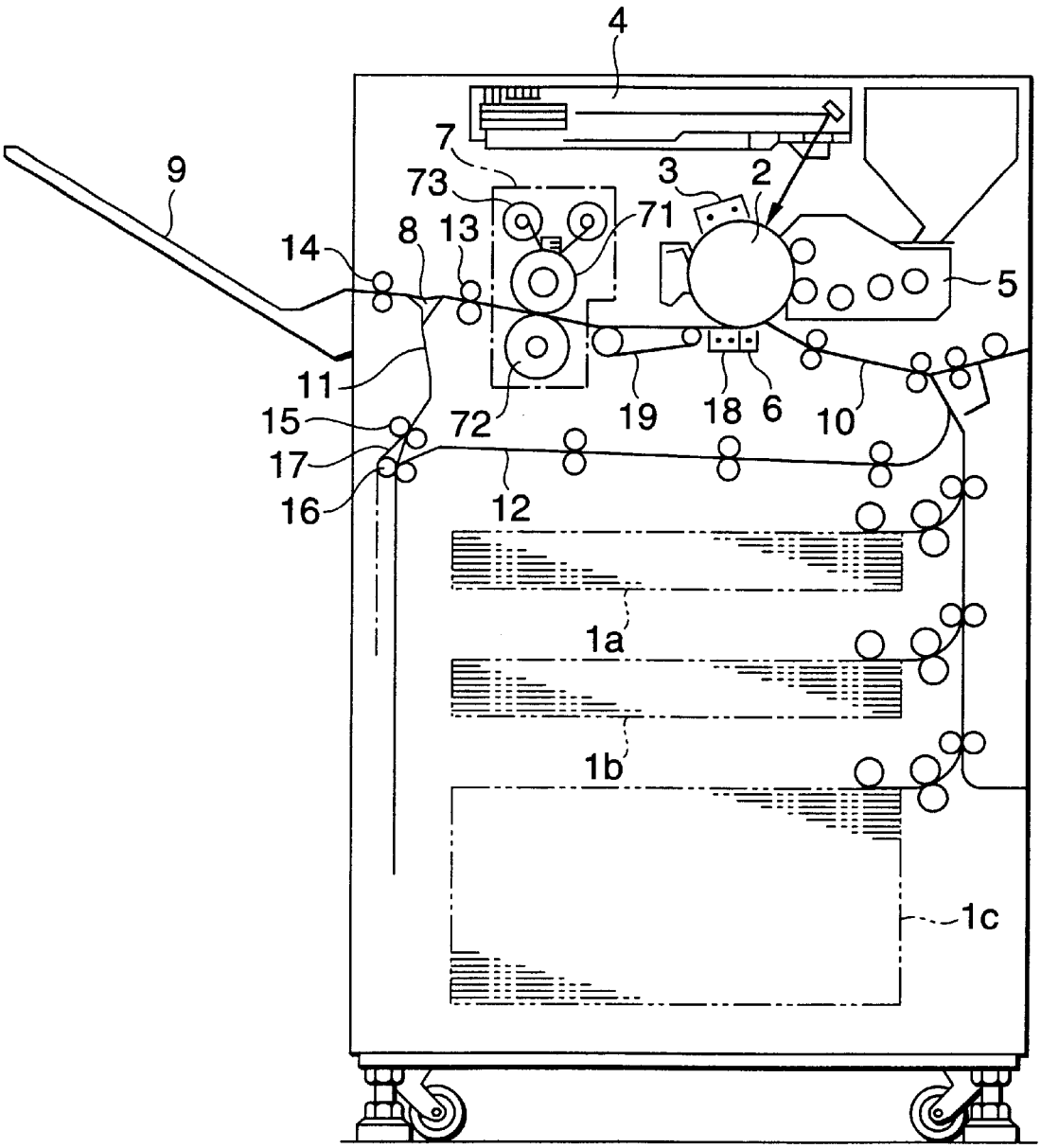
FIG. 6 is an overall schematic structural view of a laser printer of the fixing device of the present invention.

In FIG. 6, each of numerals **1*a*, 1*b* and 1*c* denotes a sheet feeding section in which sheets as a recording material are accommodated. Numeral 2 denotes a photoreceptor drum starting to rotate based on a signal from a controller (not shown). When the photoreceptor drum 2 starts the rotation, the surface of the photoreceptor drum 2 is uniformly charged by a corona charger 3. On the charged photoreceptor drum 2, an electrostatic latent image is formed by a scanning beam from an exposure device 4. When the electrostatic latent image reaches a position of a developing device 5, it is developed by toner so that the electrostatic latent image is visualized as a toner image on the photoreceptor drum 2. The toner image formed by the well-known electrophotographic process is transferred by a transfer device 6 onto a sheet fed from the sheet feeding section 1*a*, 1*b* or 1*c*. Numeral 7 denotes a fixing device to fix the toner image transferred onto the sheet. The fixing device has a heat roller 71, a pressure roller 72, a web unit 73 and the like. A detailed structure of the fixing device 7 will be described later. Numeral 8 is a flap to control the direction of the conveyed sheet. Numeral 9** is a delivery sheet tray used as a delivery sheet section, which stacks and stores sheets on which image formation has been completed.

In the following explanation, for the sake of convenience, a sheet conveyance path 10 is referred to as a "sheet feed path", which is defined by the sheet feeding section **1*a*, 1*b* and 1*c*, the image forming means 2, 3, 4, 5, 6 and 7 and the delivery sheet tray 9. Numeral 11 is a draw-in path branched from the sheet feed path 10 on the downstream side of the image forming means in the sheet conveyance direction. The sheet sent from the fixing device 7 is selectively drawn to the draw-in path by the switching control of the flap 8. Numeral 12 is a returning path branched from the middle of the draw-in path 11, an end of the returning path is connected to the sheet feed path 10** on the upstream side of the image forming means in the sheet conveyance direction.

Accordingly, when image recording is conducted on both sides of the sheet, the sheet sent from the fixing device 7 is drawn to the draw-in path 11. Thereafter, the drawn-in sheet is sent to the returning path 12, resulting in that one side of the sheet on which the image has been recorded is sent again into the image forming means. Finally, two-sided image recording is conducted.

In FIG. 6, numerals 13 and 14 are a pair of conveyance rollers provided on the front and rear side of the flap 8. Numeral 15 and 16 are a pair of conveyance rollers switchable to normally and reversely rotate, which are provided on the draw-in path 11. Numeral 17 is a flap to switch whether the sheet drawn to the draw-in path is sent to the returning path 12, or returned again to the sheet feed path 10 and delivered onto the delivery sheet tray 9. Numeral 18 is a remover unit to remove the sheet passed through the transfer device 6 from the photoreceptor drum 2 by the corona discharge. Numeral 19 is a conveyance belt mechanism to convey the sheet to the fixing device 7.

Next, referring to FIGS. 3 and 4, the structure of the web unit 73 will be described in detail.

As an outline structure, the web unit 73 includes a housing 731, two parallel shaft members 732 supported by the housing 731, a web member 733 supported to be windable between the two shaft members 732, and a heat resistive resin handle 734 stretched along a length direction of the housing 731.

Figure 3:
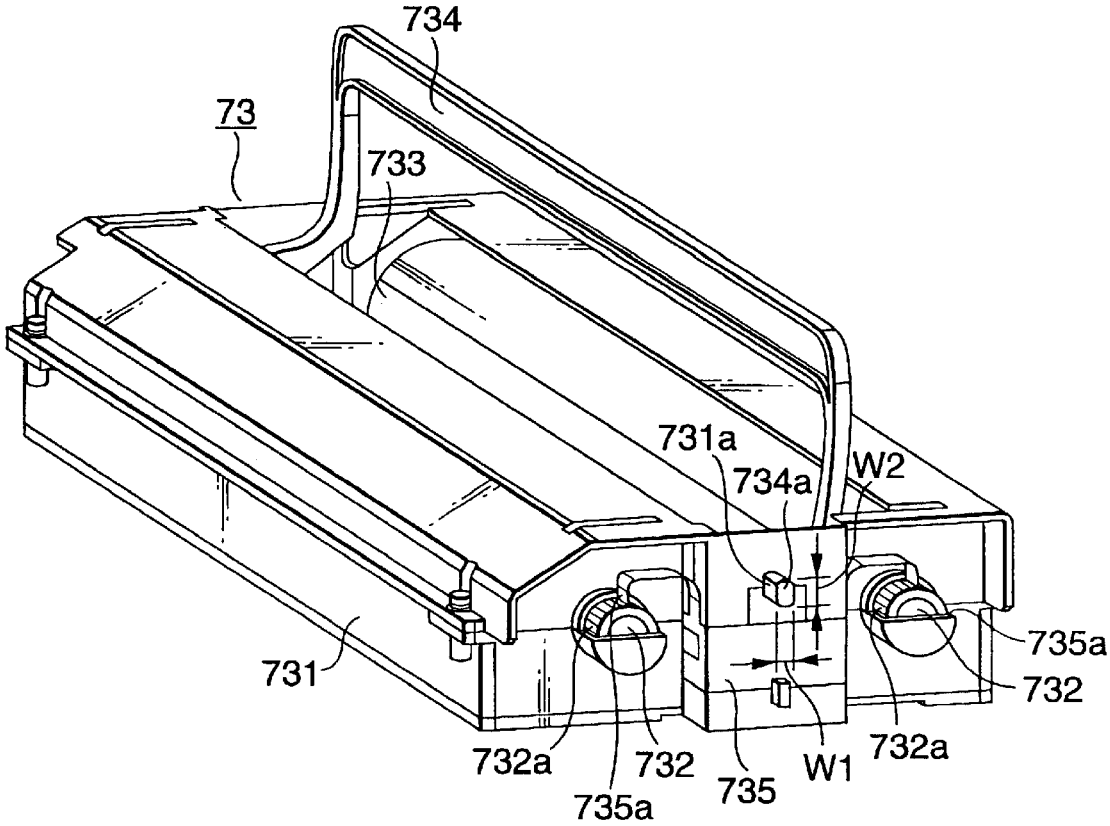
FIG. 3 is a perspective view of the web unit used for the fixing device of the present invention.
Figure 4:
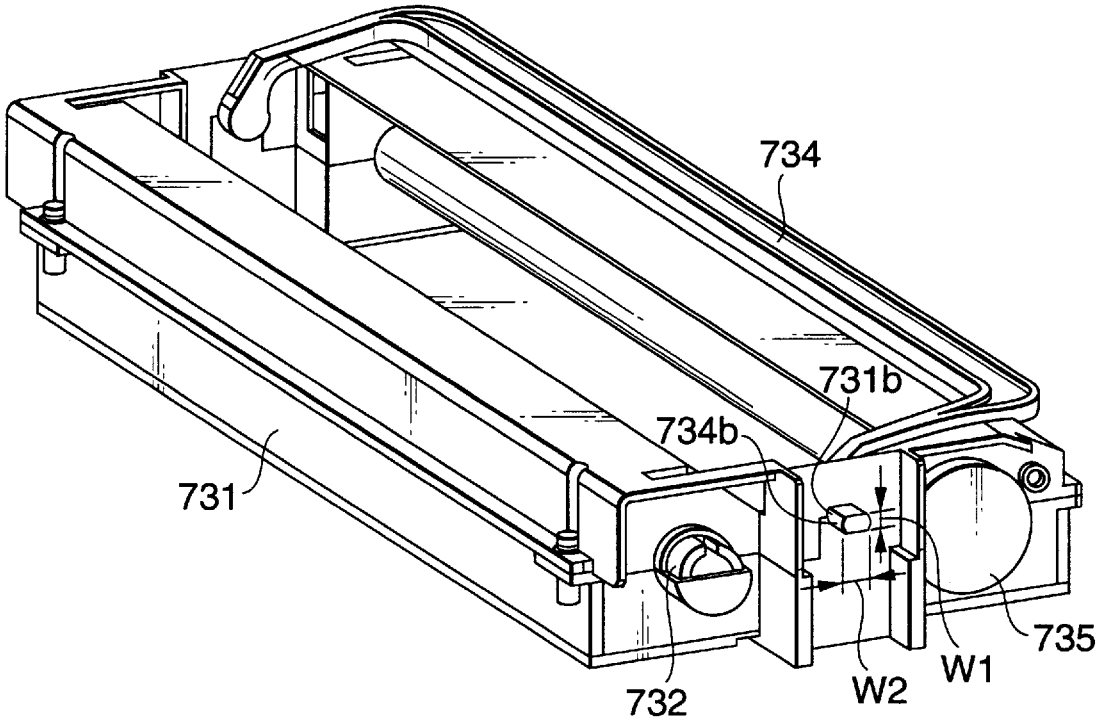
FIG. 4 is a perspective view of the web unit used for the fixing device of the present invention.

As shown in FIG. 4, on the rear side of one of the two shaft members 732, a gear 735 is provided for transmitting to the shaft member 732 the winding force to wind up the web member 733. Further, as shown in FIG. 3, on the outer peripheral surface of the front side of the shaft member 732, a groove 732*a* is defined in the axial direction. A leading edge 735*a* of a spring 735 is engaged with the groove 732*a*, thereby to prevent looseness of the web 733.

A member 734*a* is a protruded from a side surface of the housing 731 to outside as shown in FIG. 3, and a member 734*b* is protruded from the side surface of the housing 731 to outside as shown in FIG. 4. The member 734*a* and 734*b* are protrusions integrally provided with both the end portions of the handle 734. When the protrusions 734*a* and 734*b* of the handle are penetrated through through-holes 731*a* and 731*b* provided on the side surfaces of the housing 731, the handle 734 is rotatably supported by the housing 731.

Herein, it is important that the sectional shapes of the protrusions 734*a* and 734*b* provided on the handle 734 are formed to have a first width W1 and a second width W2 larger than the first width W1 as shown in FIGS. 3 and 4.

Therefore, the width of the protrusions is switched such that, when the handle 734 is stood up as shown in FIG. 3, side surfaces of the protrusion 734*a* and 734*b* defining second width W2 is vertically arranged, and when the handle 734 is brought down as shown in FIG. 4, the side surfaces of the protrusion 734*a* and 734*b* defining second width W2 is horizontally arranged.

As shown in FIG. 1, a guide groove 701 is provided on the fixing device frame 700 on which the above web unit is mounted. The guide groove 701 is provided at positions corresponding to positions of the protrusions 734*a* and 734*b* (only 734*a* is shown in FIG. 1) provided on the web unit. The guide groove 701 has a groove portion 701*a* to guide the protrusions 734*a* and 734*b* by the first width W1, and a guide portion 701*b* which makes the protrusions 734*a* and 734*b* rotatable at an end of the groove portion 701*a* and allows the switching from the first width W1 to the second width W2.

Figure 2:
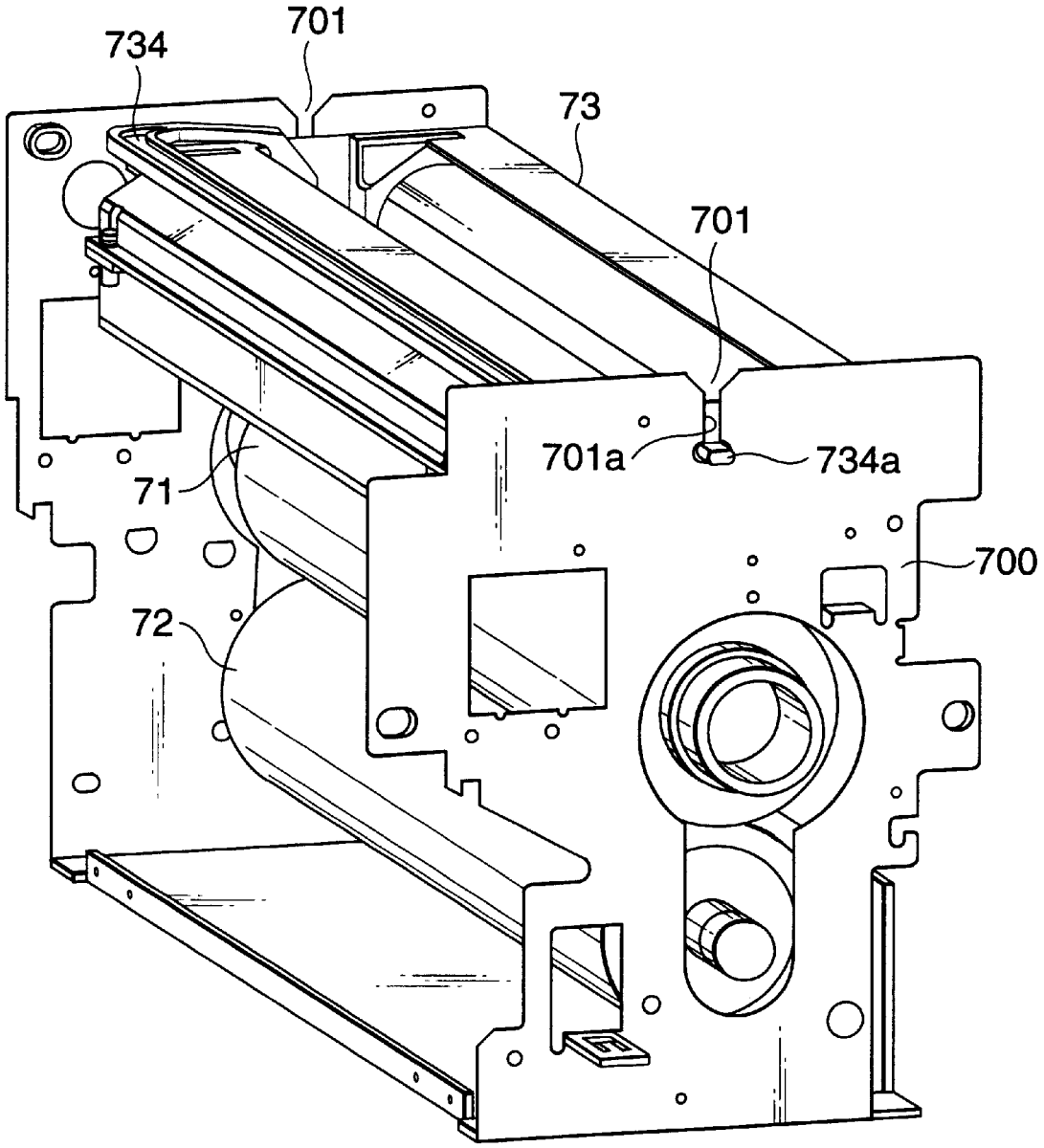
FIG. 2 is a perspective view showing a condition that the web unit has been attached to the fixing device frame in the fixing device of the present invention.

According to the above-described structure, when the web unit 73 is mounted on the fixing device frame 700, the handle 734 of the web unit is stood up, the protrusions 734*a* and 734*b* are positioned with the guide groove 701, and the web unit 73 is lowered from the upper portion of the fixing device frame 700 toward the arrowed direction A in FIG. 1. Next, when the protrusions 734*a* and 734*b* arrive at the end of the guide groove 701, that is, at the guide portion 701*b*, the handle 734 is brought down toward the arrowed direction B in FIG. 1, and becomes the condition as shown in FIG. 2. When the handle 734 becomes the condition as shown in FIG. 2, the surfaces defining the second width W2 of the protrusions 734*a* and 734*b* becomes horizontal, therefore, the movement to the groove portion 701*a* side, which is set to the width smaller than the second width W2, is restricted, thereby surely fixing the web unit 73 to the fixing device frame 700.

Further, when the web unit is detached from the fixing device frame 700, the handle 734 is stood up, and the surface defining the width W2 of the protrusions 734*a* and 734*b* is made to be vertical such that the movement toward the groove portion 701*a* can be performed, and the stood-up handle 734 is held and lifted up, resulting in the web unit 73 being detached.

Figure 5:
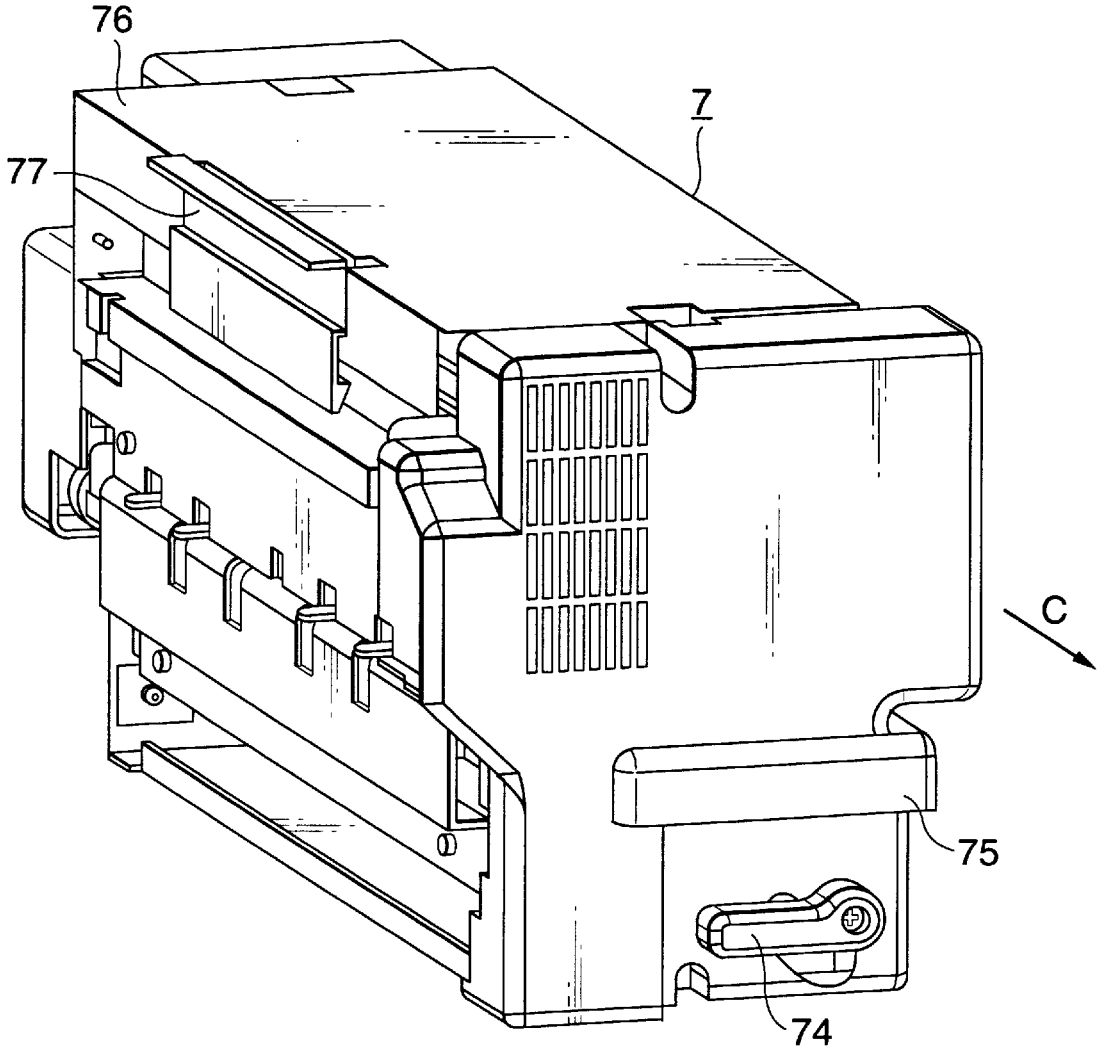
FIG. 5 is a perspective view showing an external appearance of the fixing device of the present invention.

When the fixing device is mounted on actual products, other covers are attached on the periphery of the fixing device frame shown in FIGS. 1 and 2, and external appearance of the fixing device becomes the structure as shown in, for example, FIG. 5. In the present example, the whole fixing device shown in FIG. 5 is mounted in the laser printer main body shown in FIG. 6 in such a manner that the fixing device can be pulled out in the arrowed direction C in FIG. 5.

In this case, for the pulling-out mechanism, the well-known structure may be used, for example, a guide rail is used between the printer main body and the fixing device, and when the lever 74 is rotated, for example, counterclockwise, a lock between the printer main body and the fixing device is released, the fixing device can be pulled out in the arrowed direction C in FIG. 5. Incidentally, in FIG. 5, numeral 75 denotes a pull used when the fixing device 7 is pulled out. Numeral 76 denotes a cover to cover the web unit. Numeral 77 denotes a latch mechanism to fix the cover 76 to the fixing device 7. When the cover 76 is opened, the web unit and the web unit attachment portion of the fixing device frame are exposed. Therefore, the attachment and detachment operations after that may be carried out in the processes described above.

As the web 733 used in the web unit, a web formed by impregnating silicon oil into the nonwoven fabric made of NOMEX (Trade Mark), is used.

Further, the heat roller 71 is controlled to have surface temperature of about 200° C., and the temperature of the housing 731 of the web unit located above the heat roller 71 rises to about 70 to 80° C. due to the heat from the heat roller 71.

In the fixing device of the present invention, the handle 734 is provided, and when the attachment and detachment operations of the web unit 73 are carried out, because it is made that the handle 734 is located more above the housing whose temperature is high and the temperature of the handle 734 is suppressed to about 40° C., thereby, the operator can safely replace the web unit by holding the handle 734. Incidentally, for the handle 734, it is preferably that the handle is made of heat resistive resin whose color is different from that of the housing of the web unit, so that the operator can easily recognize it.

As described above, after the handle 734 is guided to a predetermined position by the guide groove 701 provided on the fixing device frame 700, the handle 734 is rotated before the web unit 73 is fixed to the fixing device frame 700 by the second width W2 of the protrusions 734*a* and 734*b*, and the web unit 73 is regulated not to be detached. Herein, in the present example, when the handle is not surely brought down to a predetermined position, the cover 76 to cover the upper portion of the web unit 73 can not be closed, therefore, imperfect attachment of the web unit 73 to the fixing device frame 700 can be surely prevented.

As described above, according to the present invention, a high reliable fixing device, by which the replacement of the web unit can be easily and accurately carried out, and the print failure due to the imperfect or mid-attachment of the web unit to the fixing device frame is not generated, can be provided. Further, a fixing device in which the safety at the replacement of the web unit is improved, can be provided.

What is claimed is:

1. A fixing device comprising:

a web unit, including:

a housing having two shaft members in parallel with each other, the housing defining a through hole on each of two lateral sides of the housing.

a web member windably supported by the two shaft members; and a handle having two protrusions protruded from a lateral surface of the housing to outside of the housing, in which each of the two protrusions defines a first width, and a second width larger than the first width, and a fixing device frame to be detachably disposed to the web unit, the fixing device frame defining a guiding groove having:

a groove through which the two protrusions are guided on the basis of the first width; and a guiding portion at an end of the groove to allow the two protrusions to be changed from the first width to the second width;

wherein, attachment or detachment of the web unit to or from the fixing device frame is regulated corresponding to a position of the handle with respect to the housing.

2. The fixing device as claimed in claim 1, wherein the handle is made of heat resistive resin.

3. The fixing device as claimed in claim 1, wherein the handle has a color different from a color of the housing of the web unit.

4. The fixing device as claimed in claim 1, wherein temperature of the handle is about 40° C. when the fixing device is operated.

* * * * *